United States Patent [19]

Mennesson et al.

[11] 4,351,866

[45] Sep. 28, 1982

[54] FLEXIBLE STRIP FACING MATERIAL AND METHOD AND APPARATUS FOR CUTTING THE MATERIAL

[76] Inventors: Paul Mennesson, 32, Avenue du Bois, 78620 L'Etang-la-Ville; Hugues Moreau, 103, Avenue Felix Faure, 75015 Paris, both of France

[21] Appl. No.: 163,627

[22] Filed: Jun. 26, 1980

[30] Foreign Application Priority Data

Jul. 5, 1979 [FR] France ..... 79 17447

[51] Int. Cl.[3] ..... B31F 5/00; B32B 3/10; B32B 5/16

[52] U.S. Cl. ..... 428/60; 156/159; 156/304.5; 428/143; 428/148; 428/149; 428/192; 428/240; 428/241; 428/242; 428/262; 428/281; 428/325; 428/327

[58] Field of Search ..... 428/44, 60, 143, 57, 428/58, 148, 149, 192, 240–242, 262, 281, 325, 327; 156/159, 304.5

[56] References Cited

U.S. PATENT DOCUMENTS

| | | | |
|---|---|---|---|
| 2,431,035 | 11/1947 | Goepfert et al. | 428/60 |
| 3,074,789 | 1/1963 | Krogh | 156/159 |
| 3,564,782 | 2/1971 | Haywood | 156/304.5 |
| 3,770,555 | 11/1973 | Gladstone et al. | 428/60 |
| 3,930,088 | 12/1975 | Constantin et al. | 428/143 |
| 4,242,390 | 12/1980 | Nemeth | 428/60 |

*Primary Examiner*—Michael G. Wityshyn
*Attorney, Agent, or Firm*—Larson & Taylor

[57] ABSTRACT

A flexible strip facing material, formed from particles (2) of hard material bound together and secured on a perforated support (1) by means of a macromolecular binder, is adapted to be stuck by its rear face (5) to a wall or other surface in such a manner as to leave visible the face (4) covered with the particles. The edges (3 and 8) of the material are cut in bevels at the angles A and B in such a manner that when two strips are stuck edge to edge the joint between them remains imperceptible, the angle B being less than the angle A. This material is used as a facing for the protection and decoration of walls of buildings.

5 Claims, 15 Drawing Figures

Figure 1A:
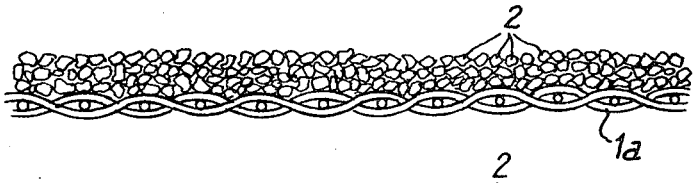

21
20
17
19
A
40
23
4
1
12
14
15
16
15

40
17
19
22
41
41
4
14
1
16
42
23

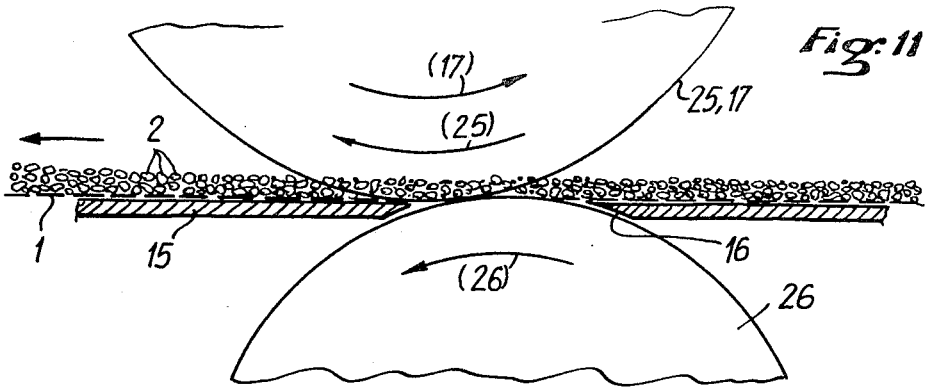
Fig: 11
Fig: 12
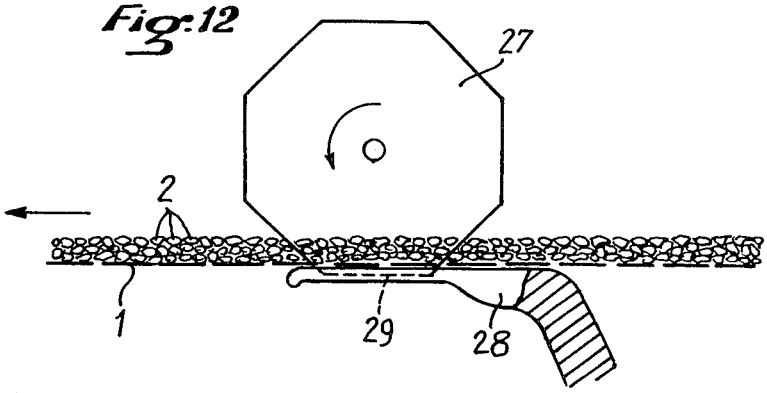
Fig: 13
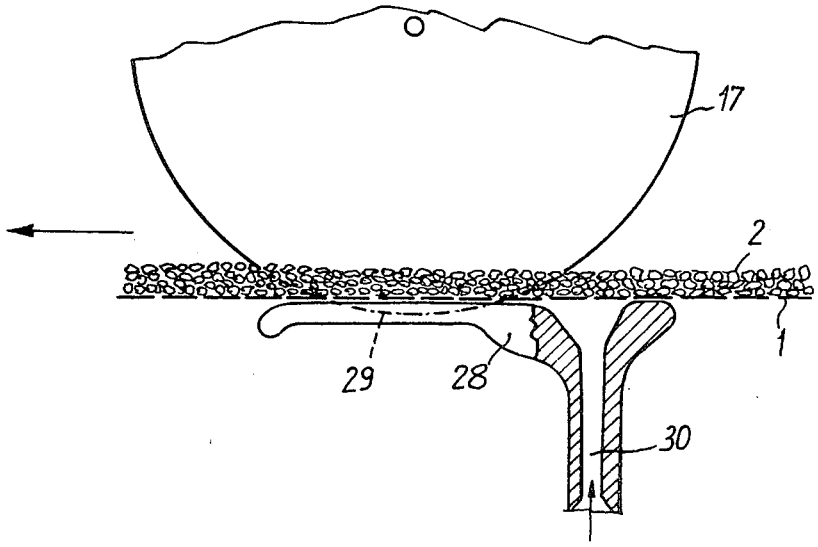

FLEXIBLE STRIP FACING MATERIAL AND METHOD AND APPARATUS FOR CUTTING THE MATERIAL

The invention relates to a facing material of the kind which is applied to the walls of buildings, particularly for protection and decoration. The invention relates more particularly to a strip facing material consisting of a flexible and extensible perforated support and of particles or granules of hard material held together and secured to one of the faces of the flexible support by means of a transparent flexible macromolecular binder with a low water retention, so as to conceal the face of the support. Such a facing material, which is adapted to be fixed to a wall or other surface by its face opposite to that carrying the particles of hard material, is described, for example, in U.S. Pat. No. 3,930,088 of Gurgui N. Constantin et al, issued Dec. 30, 1975 and in the French patent application No. 2,354,431 of Compagnie Francaise des Mines de Deze, filed June 8, 1976 which proposes, in particular, a binder consisting of a copolymer with internal plastification. To facilitate the description of the invention, the face covered with the particles of hard material is hereinafter called the "visible face" and the opposite face is called the "nonvisible face."

The material of the particles may consist in particular of at least one of the following: granite, flint, marble, glass, metal and plastics. The flexible support may be formed by a perforated film or a fibrous product which may be woven or non-woven. The binder may be an elastomeric plastics resin, a few microns thick, which is placed on and between each of the particles and the flexible support.

Such facing materials are usually offered on the market in rolled-up flexible strips, the width of which is of the order of a meter and the developed length of which may be comprised between five and a hundred meters. In general, in order to produce a facing, it is necessary to juxtapose a plurality of these strips, along their longitudinal edges or borders. Nevertheless, it is difficult to produce in this manner large areas of facing, in which the longitudinal joints are imperceptible and which avoid the appearance on the visible face either of a break in continuity in the distribution of the particles or of fragments of the flexible support. In order to overcome this difficulty, it has been proposed, in the abovementioned French patent application No. 2,354,431, to provide the facing material with one longitudinal edge without any particles while the other edge is "complete" and includes particles, which makes it possible, during placing of the strips in position, to produce an overlap between adjacent strips or widths which remain practically invisible on the visible face. To give such a strip a complete edge, it is necessary to cut it carefully in a plane perpendicular to the larger dimension of the strip (assumed to be unrolled and flat), including the particles of hard material situated astride this cutting plane. This requires a delicate and expensive operation, particularly within the framework of mass production.

The object of the invention is to create a strip facing material, of the kind defined above, in which the joints between adjacent strips or widths may be made imperceptible as a result of longitudinal edges treated by more simple and less expensive processes.

For this purpose, the facing material according to the invention is essentially characterised in that one of its longitudinal edges is cut along a first bevel in such a manner that, along this edge, the visible face of the product overhangs in relation to the nonvisible face, that is to say in relation to the flexible support, and in that its other longitudinal edge is also cut along a second bevel in such a manner that, along this other edge, the visible face of the product is set back in relation to the nonvisible face, the angle of this second bevel being less than that of the first bevel.

In this manner, the edge of the visible face of the facing material, along the margin thus cut in a first bevel, is sure to make contact with the edge of the visible face of the adjacent strip of facing material when the borders of the two strips product are juxtaposed, tightening them laterally. It then does not matter if the flexible support has not been cut strictly in a straight line because it is concealed by the overhanging edge of the visible face.

Assurance is further provided that the edges of the visible faces will touch in pairs when borders of this product are juxtaposed, tightening them laterally and merely taking care to dispose a bevel with an overhanging visible face and a bevel with a visible face set back one beside the other each time.

The angle (as defined below with the aid of the drawings) of the first bevel may advantageously be between 15′ and 45° and is preferably equal to 30°.

Preferably, also, the angle of the second bevel is between 3° and 15° and, in particular, is equal to 10°.

As already stated above, the longitudinal edges of the facing material according to the invention can be treated or cut by more simple and less expensive processes than the products belonging to the prior art. Before describing the methods according to the invention, it seems desirable to recall the main difficulties encountered by the conventional sawing methods, using a rotary diamond-edged disc and a band-saw blade.

The diamond-edged disc is suitable for cutting the assembly of hard particles alone, but the blade loses its edge very quickly. For cutting the flexible support alone, the disc is incapable of cutting it in a straight line but the blade is suitable. For cutting the binder, these two methods of sawing are suitable if they do not produce excessive heating. For cutting the facing material, the components of which have different structures and hardnesses, neither of these two sawing methods is suitable as such because the diamond-edged disc tears the flexible support and the band saw blade is immediately blunted by the particles of hard material.

It would be possible to envisage using more modern methods than sawing but these prove inapplicable in practice. In particular, the method of cutting with a laser heats the resinous binder too much and causes it to melt while the method of cutting with a micro-jet of water at very high pressure moistens the product and leaves an indelible mark on the border.

This reminder is necessary to show up the inventive activity associated with the method according to the invention which will be explained below with some of its variants.

According to the method according to the invention, to cut at least one of the longitudinal edges of the facing material in a bevel, the facing material is placed, with the interposition of a supporting sheet of paper, on a rigid support, equipped with a rectilinear slot; a rotary disc is used as a tool, preferably a diamond-edged disc, the plane of which is inclined, in relation to that of the rigid support, at an angle corresponding to that of the bevel; and the facing material and the rotary disc are displaced relative to one another, parallel to the length of the facing material, with the rotary disc each above the material and engaging it in the slot in the rigid support.

Thus a sandwich is produced: particles of hard material, flexible support, sheet of paper, which is cut with the rotary disc. It will be found that the sheet of paper acts as a temporary local support which prevents the flexible support from tearing whether the latter be a film or a woven or non-woven material.

According to a first modification of this method, the facing material is placed on a rigid support, equipped with a rectilinear slot; on the one hand a rotary disc, preferably a diamond-edged disc, the plane of which is inclined in relation to that of the rigid support at an angle corresponding to that of the bevel, and on the other hand a cutting tool are used as tools; and the facing material and the assembly of tools are displaced relative to one another, parallel to the length of the product, with the rotary disc above the facing material and engaging it gently in the slot in the rigid support whilst the cutting tool is below the rigid support and engaging it sufficiently in the slot in this to cut the flexible support of the facing material.

Within the framework of this first modification, the cutting tool may consist either of a blade or of a rotary wheel. In any case, it attacks the flexible support before the rotary disc and thus prevents it from tearing.

According to a second modification of the above-mentioned method, the facing material is placed on a rigid support, equipped with a rectilinear slot; a rotary disc, preferably a diamond-edged disc, the plane of which is inclined in relation to that of the rigid support at an angle corresponding to that of the bevel, is used as a tool; the facing material and the rotary disc are displaced relative to one another, parallel to the length of the facing material; and an intense local cooling is applied below the flexible support, particularly when it is a fibrous support, immediately before the cutting of this support by the rotary disc.

Thus made rigid by their cooling, the fibres of the flexible support became instantaneously easily sawable and are cut cleanly by the disc set with diamonds.

In the case of the method described above and its modifications, the rotary disc is preferably inclined not only in the direction of the bevel to be cut but also in such a manner that the trace of its plane on that of the rigid support forms an acute angle (as defined below by means of the drawings) with the straight line of the trimmed border. Said acute angle is preferably between 2° and 10°.

The invention likewise relates to machines for carrying out the method according to the invention and its modifications.

Figure 1B:
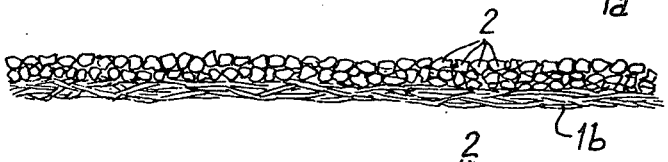
Figure 1C:
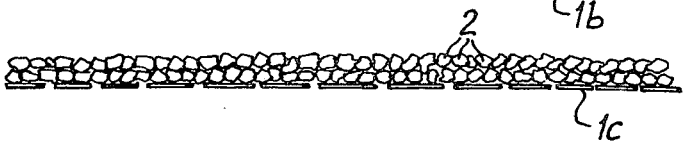
Figure 2:
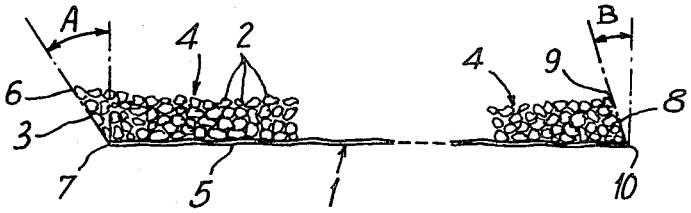
Figure 3:
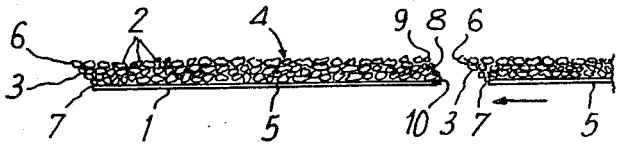
Figure 4:
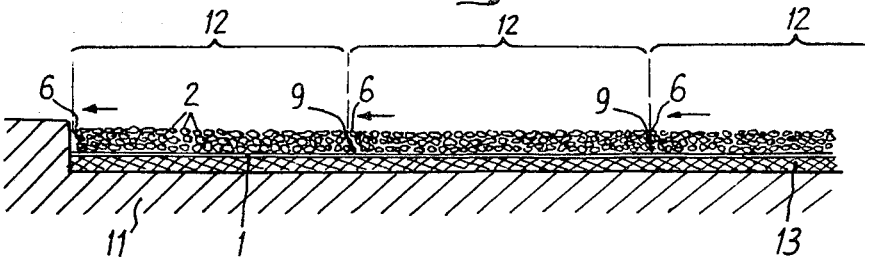
Figure 5:
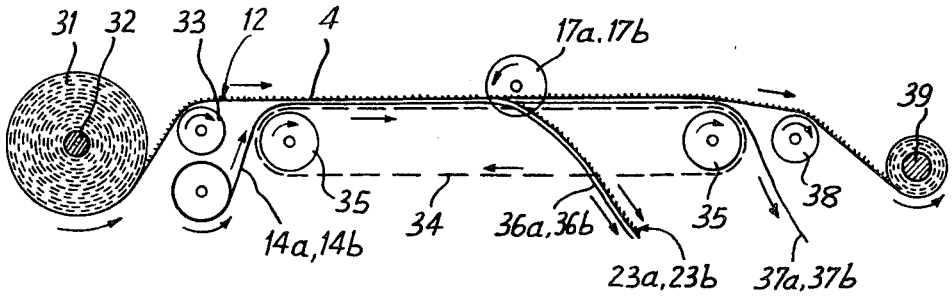
Figure 6:
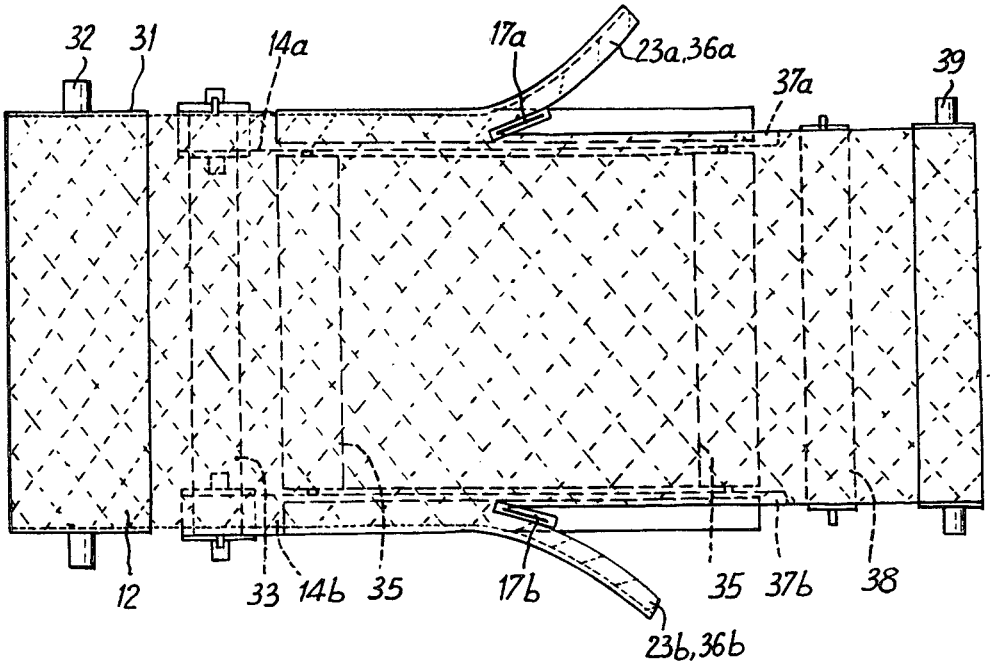
Figure 7:
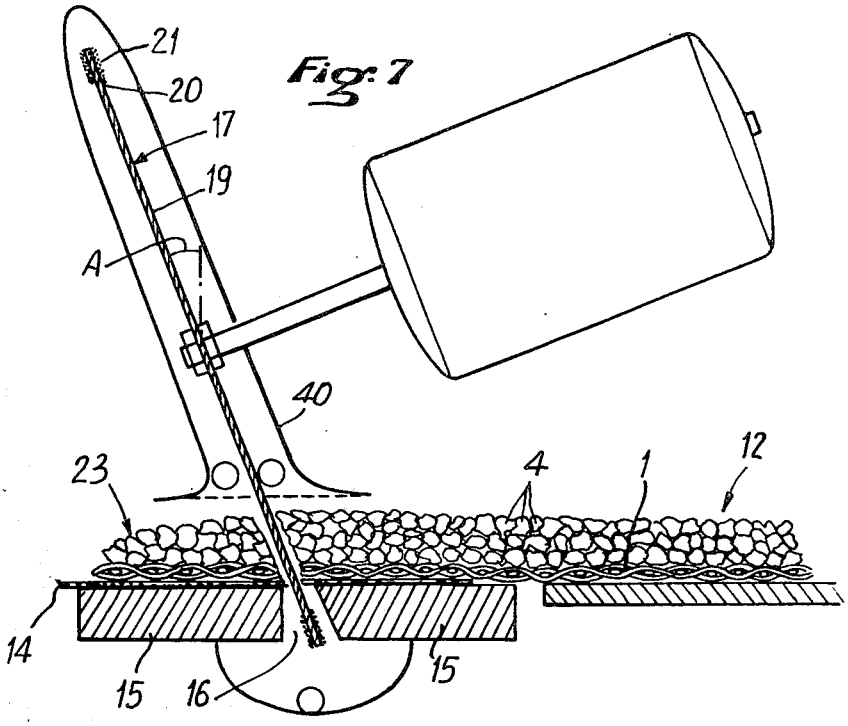
Figure 8:
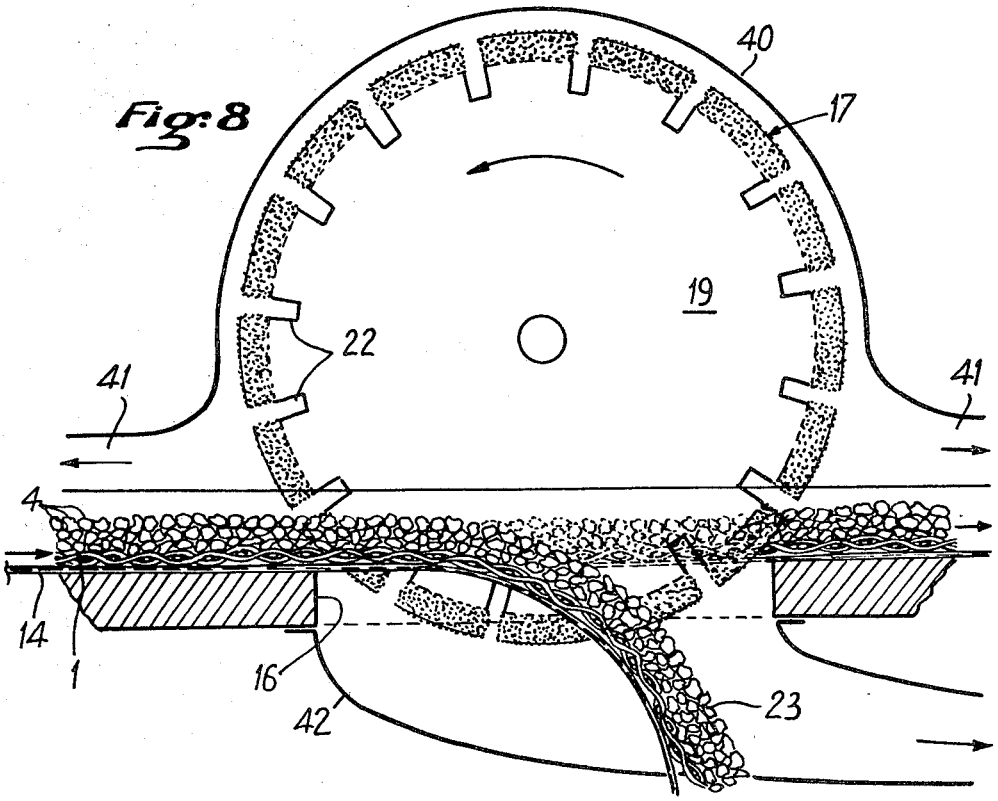
Figure 9:
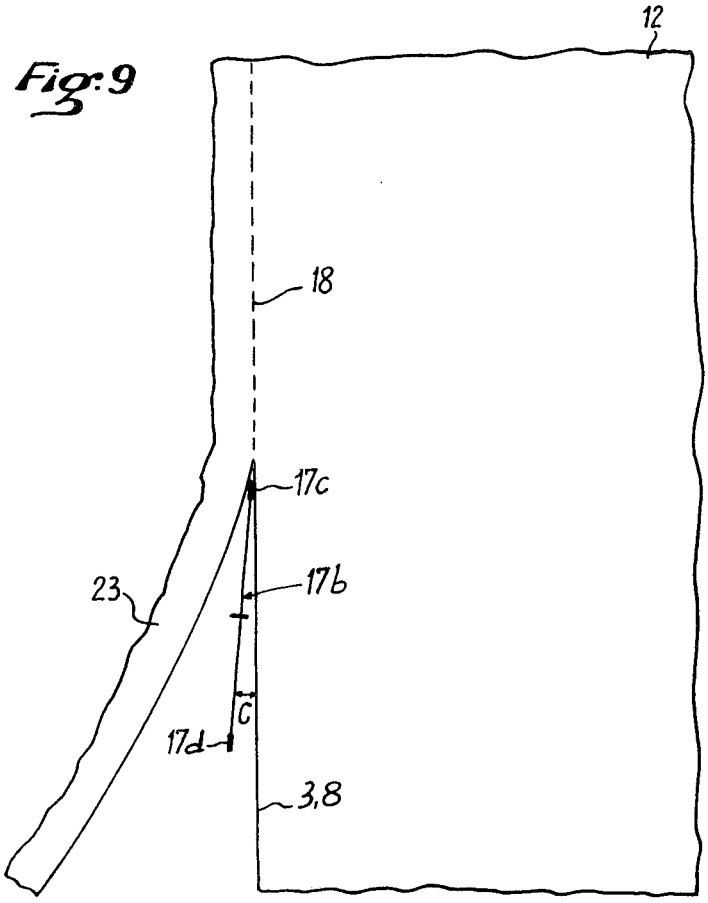
Figure 10:
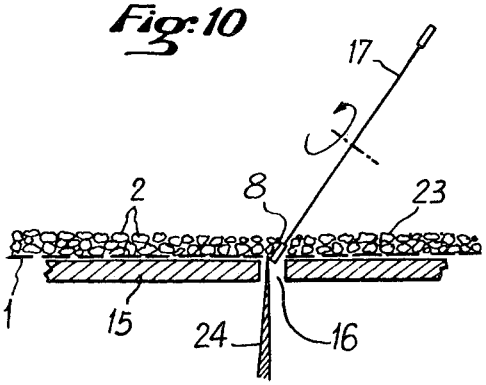

The invention will now be described, by way of example, with reference to the accompanying drawings, in which:

FIGS. 1*a*, 1*b*, 1*c* show, in longitudinal section, the three main embodiments of the facing materials to which the invention relates, FIG. 2 shows, in cross-section, a facing material according to the invention, FIGS. 3 and 4 show two successive phases in the placing in position of juxtaposed edges of the facing material according to the invention, FIGS. 5 and 6 illustrate, with views in elevation and in plan respectively, a machine for carrying out the cutting method according to the invention, FIGS. 7 and 8 show, on a larger scale, respectively in axial section and in front elevation, one of the types of diamond-edged disc which can be used in the machine of FIGS. 5 and 6, FIG. 9 illustrates, in plan view, the use of this disc, and FIGS. 10 to 13 illustrate various modifications of the method according to the invention, FIG. 10 with a view in cross-section and FIGS. 11 to 13 with views in longitudinal section.

As shown in FIG. 1, the facing material to which the invention relates consists of a perforated support 1, which is flexible and extensible, and particles of hard material 2, held together and to one of the faces of the flexible support 1, by a macromolecular binder (not visible on the scale of FIG. 1). In FIGS. 1*a*, 1*b* and 1*c*, a woven support, a non-woven support and a support formed by a perforated film are designated respectively by 1*a*, 1*b* and 1*c*.

As can be seen from the cross-section view of FIG. 2, the facing material according to the invention has one of its longitudinal edges 3 bevelled in such a manner that, along this edge 3, the visible face 4 of the product overhangs in relation to the nonvisible face 5, that is to say in relation to the flexible support 1. In other words, the edge 6 of the visible face 4 is situated beyond, in the lateral direction, the edge 7 of the visible face 4, the longitudinal edge (or border) 3 consisting of a plane face, perpendicular to the plane of FIG. 2. The angle A of the bevel, measured from a line perpendicular to both the visible face 4 and the nonvisible face 5 lies between 15° and 45°.

The other longitudinal edge 8 of the facing material is bevelled in the opposite direction, that is to say in such a manner that, along this edge 8, the visible face 4 is set back in relation to the nonvisible face 5. The longitudinal edge (or border) 8 again consists of a plane face, perpendicular to the plane of FIG. 2. The angle B of this second bevel, measured like the first in relation to a perpendicular common to the visible face 4 and invisible face 5, is less than the angle A and is preferably between 3° and 15°.

Because of the slight excess of particles 2 in the material in relation to the flexible support 1 and of the fact that the edges or borders 3, 8 are quite plane, it is possible to place the strips successively gradually compressing them (as indicated diagrammatically by horizontal arrows in FIGS. 3 and 4) to obtain imperceptible joints as they are placed in position. In FIG. 4, the wall on which the individual strips 12 of the facing material are thus juxtaposed is designated by 11 and an adhesive coating previously applied to this wall 11 is designated by 13. The result is that it is no longer necessary to cut the strips on the spot when placing them in position, hence a great gain in time (about 50%) and a notable economy in material (from 6 to 8%). The facing material according to the invention, which can be placed in position by simple application with the aid of the adhesive coating 13 without superimposing the strips and without cutting in the course of placing in position, solves the problem of the decoration and/or protection of cellular, porous thermal insulation materials which are consequently fragile and which are immediately damaged by cutting carried out in contact therewith.

In order to bevel the longitudinal edges 3 and 8 of the facing material according to the invention, the method which is illustrated in FIGS. 5 to 9 is preferably used.

For this purpose, the material is placed, with the interposition of a supporting sheet of paper 14, on the rigid support (or table) 15, equipped with a rectilinear slot 16 (FIGS. 7 and 8); a rotary disc 17, the plane of which is inclined, in relation to that of the rigid support 15, at an angle corresponding to that A or B of the bevel, is used as a tool; and the facing material and the rotary disc 17 are displaced in relation to one another, parallel to the length of the material (indicated diagrammatically by the broken line 18 in FIG. 9) with the rotary disc 17 above the material and engaging it in the slot 16 in the rigid support 15. Preferably, the rotary disc 17 is a diamond-edged disc of the known type which is illustrated in axial section in FIG. 7 and in plan in FIG. 8. As is known, such a disc consists of a thin circle of steel 19 of which the peripheral edge 20 is equipped with a set of diamond particles 21, possibly with radial slots 22 extending towards the interior in the thin portion of the steel circle 19.

As illustrated diagrammatically in FIG. 9, the rotary disc, particularly the diamond-edged disc 17, is preferably inclined in such a manner that the trace of its plane on that of the rigid support 15 forms an acute angle C with the slot 16 in the support 15, that is to say with the straight line 18 of the trimmed border. This acute angle is such that the leading or front edge 17*c* of the rotary disc attacks the strip 12 at the level of its longitudinal edge 3 or 8, but its trailing or rear edge 17*d* moves away from this longitudinal edge 3 or 8 at the same time removing the trimming 23, that is to say the portion of the strip of raw product which is detached from the strip 12.

With such cutting, on the cross with the saw set with diamonds, the flexible support 1 is sawn and not cut. If the support is a textile support, the ends of the fibres of each thread of the support form minute tufts but all the threads are severed at the same height, in a very rectilinear manner, along the length of the facing material.

In this case, a fringe of particles sawed in a rectilinear manner, which pass beyond the cutting line of the flexible support 1 are seen on the edge 3, where there is an excess of particles 2 in relation to the flexible support 1, seen from above. If this edge 3 is examined from above, only particles are seen, cut in a straight line, without any lacuna revealing the flexible support 1. On the edge 8, where there is an excess of flexible support 1 in relation to the grains 2, seen from above, all the tufts of the ends of the threads severed in a straight line are seen with the grains set back; seen from below, only the flexible support 1 is seen, the threads of which are severed in a straight line. If the cut edge of the grains cut with the saw set with diamonds is observed with a microscope, very fine lines in an arc of a circle, characteristic of this cutting are seen, which are the traces left by the particles of diamond on the cut edges of the severed grains.

The cutting machine which is illustrated in FIGS. 5 and 6 is preferably used to carry out the method which has just been described.

The facing material appears in rolls 31 supported by a mandrel 32 of a width of about 105 cemtimeters, in variable lengths from 20 to 100 meters. The particles 2 are at the inside face and come to the outside, during unrolling to open out.

A freely rotating cylinder 33 permits a constant horizontal positioning of the flexible facing strip; this permits the introduction of two strips of paper 14*a* and 14*b* between the bottom of the facing material and an endless drive belt 34, which passes over two parallel horizontal cylinders 35. The machine comprises two symmetrical cutting stations, the rotary discs of which are designated respectively by 17*a* and 17*b*, where the covering is cut to the selected width, for example 100 centimeters, with the bevelled edges 3 and 8 already described. At these places, the trimming or strip 23*a*, 23*b* of material cut at the border and about half 36*a*, 36*b* of the strip of paper 14*a*, 14*b* cut at the same time beneath it are collected. The other two halves 37*a* and 37*b* of the strips of paper are collected at the place where the trimmed covering leaves the drive belt 34. The belt then passes over another freely rotating cylinder 38 and is then wound on a receiving mandrel 39.

As can be seen from FIGS. 7 and 8, the cutting disc 17 is equipped with a casing 40 which is tangent to the product and widens out horizontally; two suction means 41, upstream and downstream collect the dust. In a modification, the machine could include only one suction means downstream with an introduction of compressed air upstream, through a profiled nozzle. The underneath of the longitudinal slot 16 in the cutting table 15 is equipped with a casing 42 connected to the dust suction system.

The modifications of FIGS. 10 to 13 aim at preventing the flexible support 1 from fraying by means other than the interposed sheet of paper 14. Apart from that, the method and its effects remain practically the same.

According to the modification of FIG. 10, a cutting blade 24 is engaged from below in the slot 16 in the rigid support 15.

According to the modification of FIG. 11, the cutting is effected by means of two wheels 25, 26 of tungsten steel or of tungsten carbide which rotate in opposite directions indicated by the arrows (25) and (26), respectively above and below the rigid support 15; the wheel 25 may be replaced by the diamond-edged disc 17 of the previous figures, which then rotates in the same direction (17) as the lower wheel 26.

The modification of FIG. 12 relates to cutting by means of a polygonal wheel 27, sharpened into a blade, which penetrates into a claw foot 28 with a very narrow slot 29.

Finally, the modification of FIG. 13 relates to cutting by means of cryo-sawing. This method uses an intense local cooling applied from below to the fibres of the flexible support 1, immediately before they are cut with the saw 17 set with diamonds, by means of a nozzle 30 composing the first portion of a claw foot 28 with a very narrow slot 29 and blowing a jet of air of liquid nitrogen onto the fibres.

We claim:

1. A strip facing material having a visible face and an opposed nonvisible face and adapted to be applied to the walls of buildings, comprising a flexible and extensible perforated support, and a covering of particles of hard material bound together and secured to one of the faces of the flexible support by a flexible transparent macromolecular binder with a low water retention, characterised in that one of the two longitudinal edges of the strip facing material is cut in a first bevel in such a manner that, along this edge, the visible face of the facing material overhangs in relation to the nonvisible face, and in that its other longitudinal edge is cut in a second bevel in such a manner that, along this other edge, the visible face of the facing material is set back in relation to the nonvisible face, the angle of the second bevel measured from a line perpendicular to said faces being less than that of the first bevel.

2. A facing material as claimed in claim 1, characterised in that the angle of the first bevel is in the range from 15° to 45°.

3. A facing material as claimed in claim 2, characterised in that the angle of the first bevel is 30°.

4. A facing material as claimed in claim 2, characterised in that the angle of the second bevel is in the range from 3° to 15°.

5. A facing material as claimed in claim 4, characterised in that the angle of the second bevel is 10°.

* * * * *